US005983418A

United States Patent [19]

Goodman et al.

[11] Patent Number: 5,983,418

[45] Date of Patent: Nov. 16, 1999

[54] SEATING AND KNEELING ASSEMBLY WITH WEDGE-SHAPED ADJUSTABLE SEAT BASE AND HEIGHT ADJUSTABLE ARM REST

[75] Inventors: Sidney R. Goodman, P.O. Box 90529, San Diego, Calif. 92169; Thomas J. Ryan, Del Mar, Calif.

[73] Assignee: Sidney R. Goodman, San Diego, Calif.

[21] Appl. No.: 09/149,197

[22] Filed: Sep. 8, 1998

[51] Int. Cl.[6] ..... A47K 3/024

[52] U.S. Cl. ..... 4/571.1; 4/559; 4/578.1; 297/423.11

[58] Field of Search ..... 4/546, 559, 571.1, 4/573.1, 574.1, 578.1, 579, 580, 584, 589, 590, 661, 254; 297/423.11, 452.21

[56] References Cited

U.S. PATENT DOCUMENTS

| | | | |
|---|---|---|---|
| D. 35,304 | 11/1901 | Pendergast | 4/559 |
| 2,140,902 | 12/1938 | Fischer | 4/185 |
| 4,356,575 | 11/1982 | Terry | 4/559 |
| 4,385,408 | 5/1983 | Rhodes | 4/523 |
| 4,534,590 | 8/1985 | Yamamura et al. | 297/180 |
| 4,630,323 | 12/1986 | Sage et al. | 4/580 |
| 4,650,249 | 3/1987 | Serber | 297/313 |
| 4,913,487 | 4/1990 | Breckel et al. | 297/14 |
| 4,937,897 | 7/1990 | Barnabie | 4/580 |
| 5,401,078 | 3/1995 | Riach | 297/423.11 |
| 5,642,535 | 7/1997 | Frawley et al. | 4/559 |

*Primary Examiner*—David J. Walczak
*Assistant Examiner*—Tuan Nguyen
*Attorney, Agent, or Firm*—Flanagan & Flanagan; John K. Flanagan; John R. Flanagan

[57] ABSTRACT

A seating and kneeling assembly includes a front base member, a rear base member, a seat and a top member. A top side of the front base member defines kneeling pads for receiving knees of a user. The rear base member at a forward portion is connected to the front base member at a rear portion. The rearward portion of the rear base member has a substantially wedge-shaped configuration narrowing from a front to a rear thereof for accommodating the lower legs and feet of the user along opposite sides of the rearward portion. The seat is mounted to an upper portion of the rear base member for receiving buttocks of the user. The top member is supported by upper and lower support members at a height above a front portion of the front base member. A top side of the top member defines a rest for receiving forearms of the user. A bottom side of the top member is for resting on a top of a wall of a bathtub. The assembly also includes an elongated shaft on the forward portion of the rear base member which is telescopingly movable within a channel on the rear portion of the front base member for relocating the front and rear base members toward and away from one another. The assembly further includes an insert support member connectable with and between the upper and lower support members to provide the top member with additional height adjustment above the front base member.

19 Claims, 3 Drawing Sheets

SEATING AND KNEELING ASSEMBLY WITH WEDGE-SHAPED ADJUSTABLE SEAT BASE AND HEIGHT ADJUSTABLE ARM REST

BACKGROUND OF THE INVENTION

1. Field of the Invention

The present invention generally relates to seating and kneeling appliances and, more particularly, is concerned with a seating and kneeling assembly with telescopingly adjustable wedge-shaped seat base and height adjustable arm rest.

2. Description of the Prior Art

Many people kneel or sit beside a bathtub when bathing a child or pet or cleaning the bathtub. The process of bathing a child or pet or cleaning a bathtub can be burdensome. People often find themselves kneeling on a bathroom floor, resting their arms on a bathtub surface and sitting on their heels. A variety of devices and appliances have been developed over the years to aid people in this unpleasant activity.

A representative example of a prior art appliance for assisting a user in bathtub bathing and cleaning is disclosed in U.S. Pat. No. 5,642,535 to Frawley et al. The Frawley et al patent discloses a seating and kneeling appliance which includes a seat, a pair of kneeling pads and an arm rest for the user. Problems exist, however, with the design of the Frawley et al appliance. The Frawley et al design has a seat support base of a substantially rectangular configuration which limits where the legs and feet of the user can be placed. Also, the seat is not adjustable relative to the kneeling pads for people of different sizes. Further, the arm rest is not adjustable for fitting walls of bathtubs of different heights.

Consequently, a need remains for an assembly which provides a solution to the aforementioned problems without introducing any new problems in place thereof. introducing any new problems in place thereof.

SUMMARY OF THE INVENTION

The present invention provides a seating and kneeling assembly designed to satisfy the aforementioned need. The seating and kneeling assembly of the present invention includes a seat base member configured to accommodate feet of a user. The seating and kneeling assembly also includes a seat which is horizontally adjustable relative to kneeling pads for people of different sizes. The seating and kneeling assembly further includes an arm rest which is vertically adjustable for fitting the walls of bathtubs of different heights.

Accordingly, the present invention is directed to a seating and kneeling assembly which comprises: (a) a front base member having opposite top and bottom sides and opposite front and rear portions, the top side defining kneeling rests for receiving knees of a user, the bottom side for resting on a floor, the front side for placement adjacent to a wall of a bathtub; (b) a rear base member having opposite upper and lower portions and opposite forward and rearward portions, the lower portion for resting on the floor, the forward portion of the rear base member and the rear portion of the front base member being connected to one another to provide a connection between the rear and front base members; and (c) a seat mounted to the upper portion of the rear base member for receiving buttocks of the user. More particularly, the rearward portion of the rear base member has a substantially wedge-shaped configuration narrowing from a front thereof located adjacent to the forward portion to a rear thereof located remote from the forward portion for accommodating lower legs and feet of the user along opposite sides of the rearward portion of the rear base member.

The seating and kneeling assembly also comprises means defined on the rear portion of the front base member and the forward portion of the rear base member for releasably adjusting the location of the connection between the front and rear base members to selectively relocate the front and rear base members toward and away from one another. The releasably adjusting means includes an elongated channel formed on one of the rear portion of the front base member and the forward portion of the rear base member, an elongated shaft formed on the other of the rear portion of the front base member and the forward portion of the rear base member and being telescopingly movable within the channel, and means for releasably fastening the shaft and channel to one another at different selected telescoping positions of the shaft within the channel so as to correspondingly selectively relocate the front and rear base members toward and away from one another.

The seating and kneeling assembly further comprises a top member having opposite top and bottom sides and opposite front and rear ends and means for supporting the top member at its rear end at a height above the front portion of the front base member. The top side of the top member defines a rest for receiving forearms of the user whereas the bottom side is for resting on a top of the wall of the bathtub. The supporting means includes a lower support member having upper and lower ends and being attached at its lower end with the front portion of the front base member and extending upwardly therefrom, an upper support member having upper and lower ends and being attached at its upper end to the rear end of the top member and extending downwardly therefrom, and first fastening means on each of the upper end of the lower support member and lower end of the upper support member for releasably securing the upper and lower support members to one another. For changing the height of the top member above the front portion of the front base member, the supporting means further includes an insert support member having opposite upper and lower ends and being disposed between the lower and upper supported members and second fastening means on each of the upper and lower ends of the insert support member being releasably connectable to the first means on each of the upper end of the lower support member and lower end of the upper support member for releasably securing the insert support member to and between the lower and upper support members.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2:
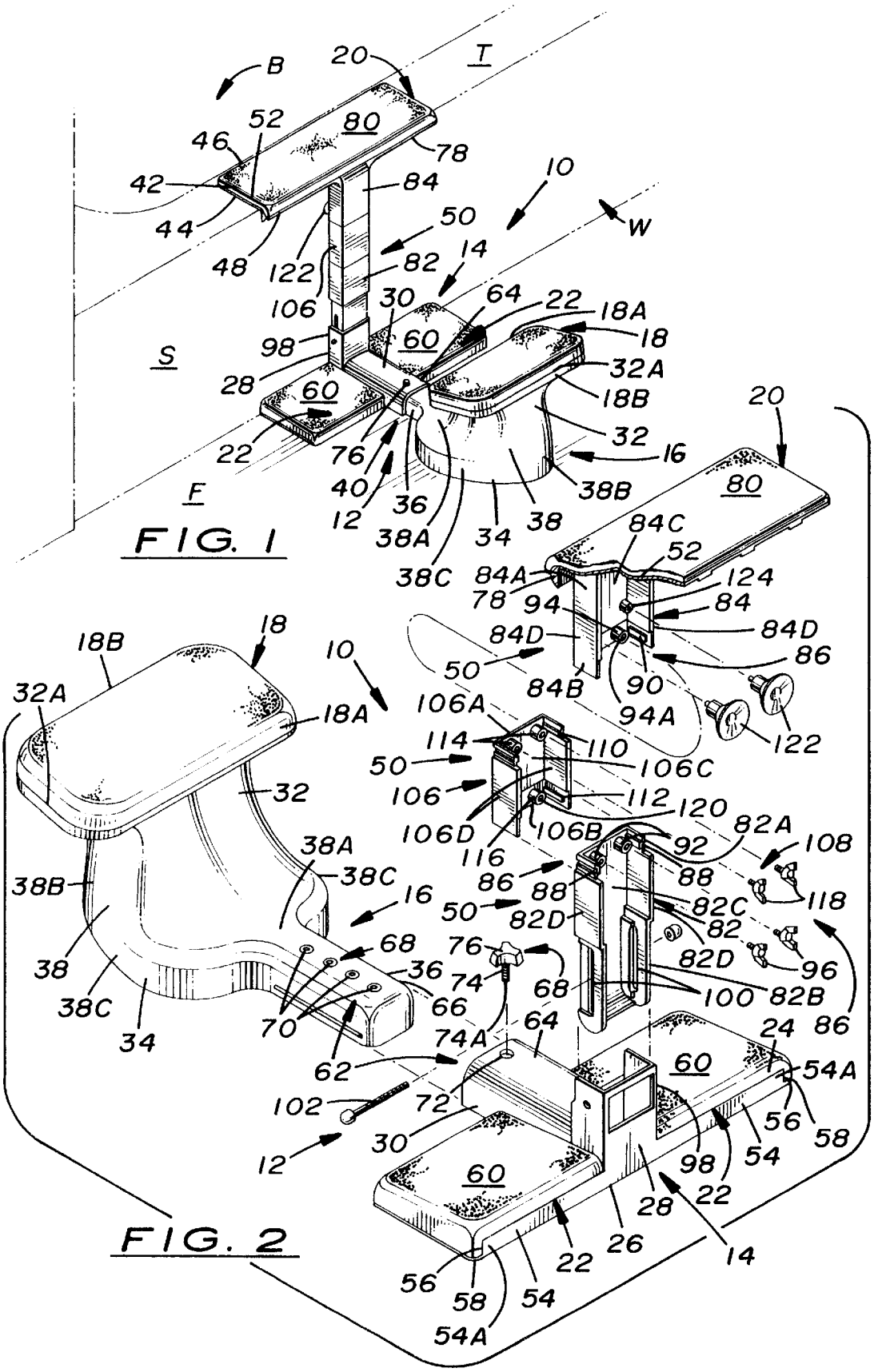
FIG. 1 is a perspective view of a seating and kneeling assembly of the present invention.
FIG. 2 is an enlarged exploded perspective view of the seating and kneeling assembly.
Figure 3:
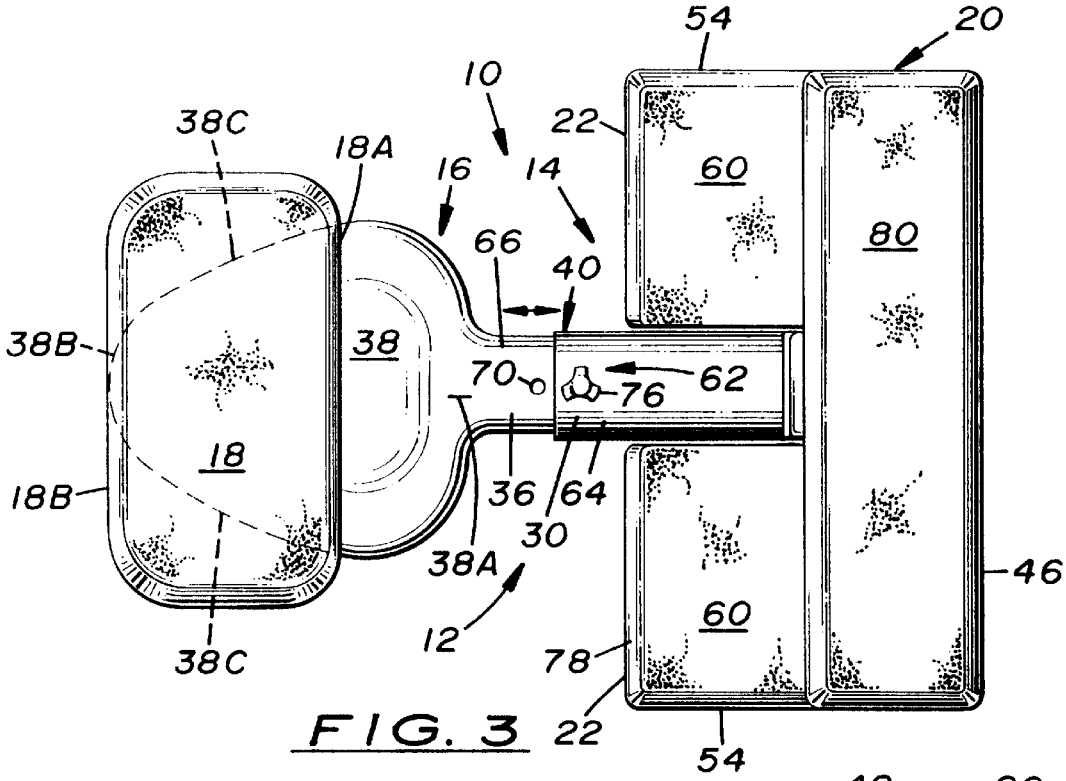
FIG. 3 is an enlarged top plan view of the assembly.
Figure 4:
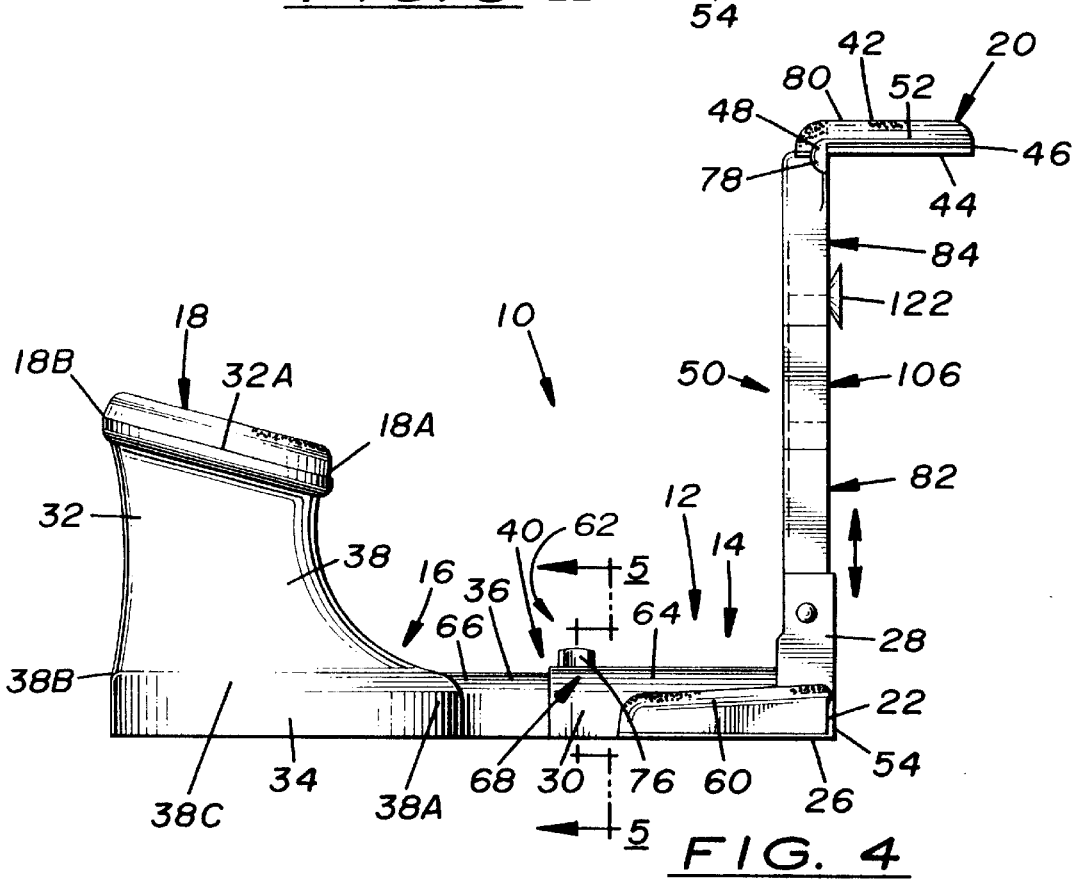
FIG. 4 is a side elevational view of the assembly as shown in FIG. 3.
Figure 7:
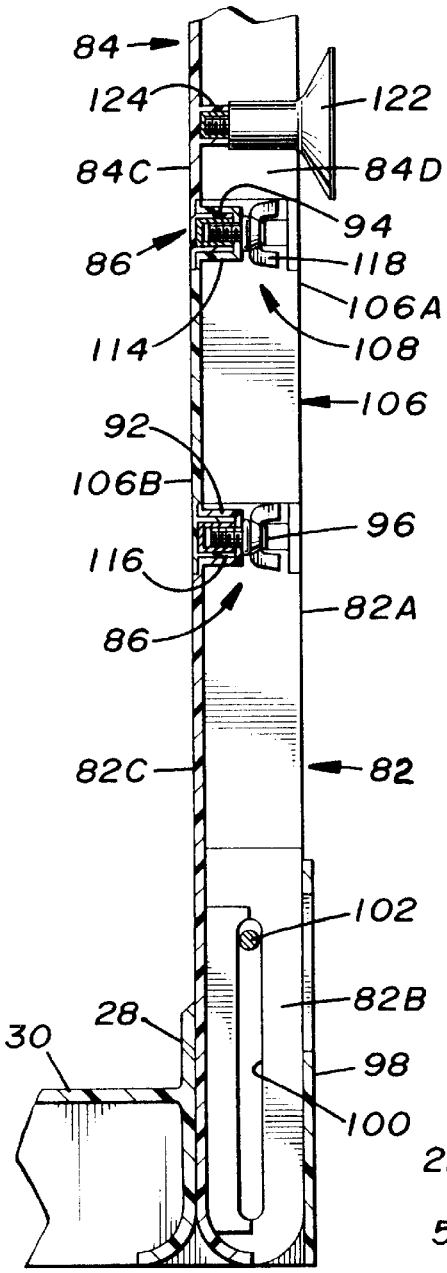
FIG. 7 is a vertical sectional view of the assembly taken along line 7—7 of FIG. 6.
Figure 6:
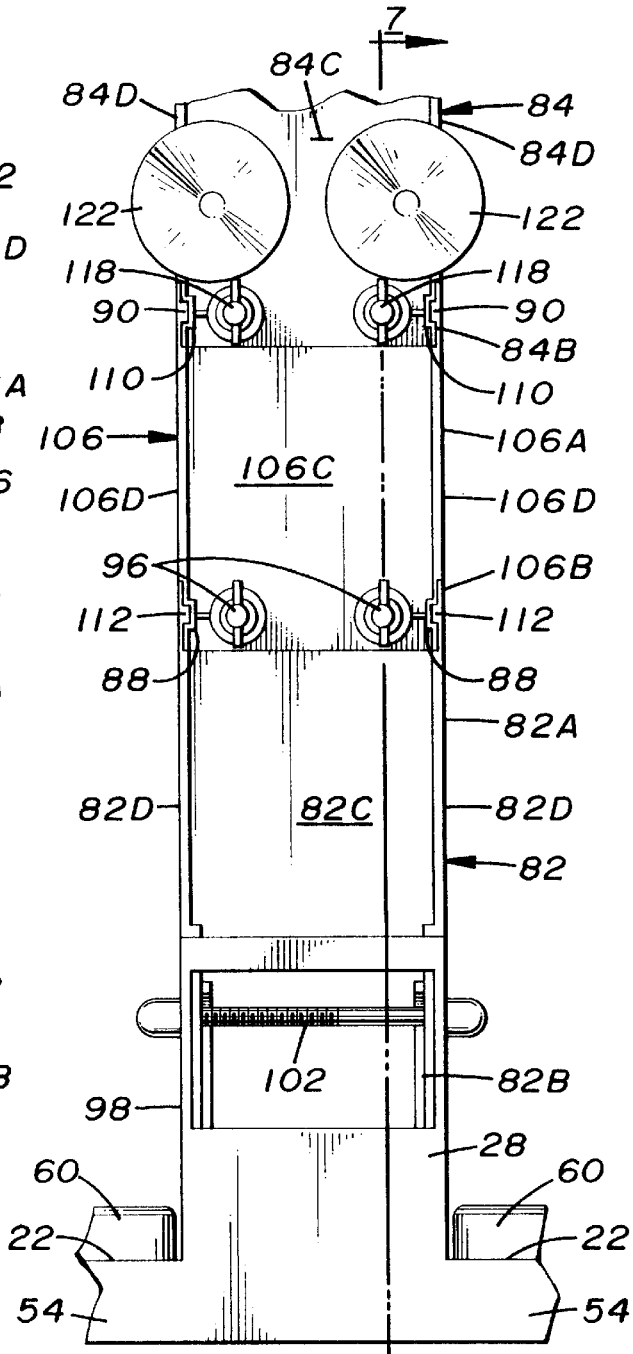
FIG. 6 is an enlarged fragmentary front view of the assembly.

Referring to the drawings and particularly to FIG. 1, there is illustrated a seating and kneeling assembly, generally designated 10, of the present invention. Basically, the seating and kneeling assembly 10 includes a base 12 having a front base member 14 and a rear base member 16, a seat 18 mounted on the rear base member 16, a top member 20 mounted upright on the front base member 14 and a pair of kneeling rests 22 on the front base member 14. The front base member 14 of the base 12 of the assembly 10 has opposite top and bottom sides 24, 26 and opposite front and rear portions 28, 30. The top side 24 of the front base member 14 defines the kneeling rests 22 which are connected to the opposite lateral sides of the front and rear portions 28, 30 of the front base member 14 and extend in opposite directions therefrom for receiving knees (not shown) of a user. The bottom side 26 of the front base member 14 is flat and thus adapted for resting on a floor F. The front portion 28 of the front base member 14 is adapted for placement adjacent to a side S of a wall W of a bathtub B.

The rear base member 16 of the base 12 of the assembly 10 has opposite upper and lower portions 32, 34 and opposite forward and rearward portions 36, 38. The lower portion 34 of the rear base member 16 is flat and thus adapted for resting on the floor F. The forward portion 36 of the rear base member 16 and the rear portion 30 of the front base member 14 are connected to one another to provide a connection 40 between the front and rear base members 14, 16. The seat 18 of the assembly 10 is mounted on the upper portion 32 of the rear base member 16 for receiving buttocks (not shown) of the user.

The top member 20 of the assembly 10 has opposite top and bottom sides 42, 44 and opposite front and rear ends 46, 48 and is supported by an upright support means 50 at a height above the front portion 28 of the front base member 14. The top side 42 of the top member 20 defines an arm/elbow rest 52 for receiving forearms or elbows (not shown) of the user. The bottom side 44 of the top member 20 is flat and thus adapted to rest on a top T of the wall W of the bathtub B. The top member 20 at its bottom side and rear end 44, 48 is mounted by the upright support means 50 above the front portion 28 of the front base member 14.

Referring now to FIGS. 1 to 4, the front base member 14 of the base 12 has a substantially T-shaped configuration. The front base member 14 has a pair of lands 54 of generally rectangular configuration connected to and extending outwardly in opposite directions from opposite sides of the front and rear portions 28, 30 of the front base member 14 so as to define the kneeling rests 22 thereon. Each of the lands 54 has a recess 56 formed in its outer end 54A so as to define a ledge 58 at the bottom of the recess 56 extending along the outer end 54A. Each land 54 and ledge 58 of the kneeling rests 22 is overlaid by and covered with a kneeling pad 60 of a relatively soft compressible cushion-like material having a substantially L-shaped configuration conforming to the shape of the top side 24 of the land 54 and ledge 58. Thus, the kneeling pad 60 is disposed on and over the land 58, extends within the one recess 56 and sits on the one ledge 58. The top side 24 of the land 54 is inclined such that the top side 24 is higher above the floor F at the front thereof located adjacent to the bathtub wall W than at the rear thereof remote from the bathtub wall W. Each kneeling pad 60 is likewise higher above the floor F at the front thereof located adjacent to the bathtub wall W.

The rearward portion 38 of the rear base member 16 has a substantially wedge-shaped configuration narrowing from a front 38A thereof located adjacent to the forward portion 36 of the rear base member 16 to a rear 38B thereof located remote from the forward portion 36 of the rear base member 16. This wedge-shaped configuration of the rearward portion 38, by being wider at the front 38A than at the rear 38B thereof, readily and confortably accommodates the extension of the lower legs and feet (not shown) of the user along opposide sides 38C of the rearward portion 38 of the rear base member 16. The rearward portion 38 of the rear base member 16 extends upwardly from the lower portion 34 thereof in a pedestal-like fashion to the upper portion 32 where an inclined summit 32A is formed thereon. The summit 32A is surmounted by and supports the seat 18 in a forwardly and downwardly inclined orientation extending toward the front base member 14 such that a rear end 18A of the seat 18 is disposed higher above the floor F than is a front end 18B thereof. The seat 18 has a substantially rectangular configuration and conforms to the shape of the inclined summit 32A of the upper portion 32. The seat 18 is in the form of a pad of relatively soft cushion-like compressible material.

Figure 5:
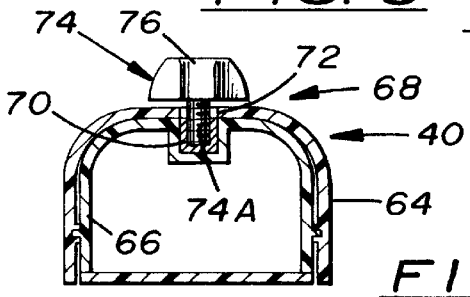
FIG. 5 is an enlarged cross-sectional view of the assembly taken along line 5—5 of FIG. 4.

Referring to FIGS. 1 to 5, means 62 are provided on the rear portion 30 of the front base member 14 and the forward portion 36 of the rear base member 16 for releasably adjusting the location of the connection 40 between the front and rear base members 14, 16 so as to selectively relocate the front and rear base members 14, 16 toward and away from one another. In such manner the fore-and-aft extending length of the assembly 10 can be changed to accommodate users having legs of different lengths. More particularly, the releasable adjusting means 62 includes an elongated channel 64, an elongated shaft 66 and releasable fastening means 68. The channel 64 preferably is formed on the rear portion 30 of the front base member 14 and thus extends between the kneeling rests 22 and rearwardly from the front portion 28 thereof. The elongated shaft 66 preferably is formed on the forward portion 36 of the rear base member 16 and thus extends forwardly from the front 38A of the rearward portion 38 of the rear base member 16. The shaft 66 of the rear base member 16 is disposed and telescopingly movable within the channel 64 of the front base member 12. Alternatively, the channel 64 could be formed on the forward portion 36 of the rear base portion 16 and the shaft 66 could be formed on the rear portion 30 of the front base member 14. Preferably, as best seen in FIG. 5, the shaft 66 has a hollow and substantially rectangular configuration in cross-section. The shaft 66 is enough smaller in cross-sectional size than the channel 64 such that the channel 64 completely covers the portion of the shaft 66 extending within the channel 64. The releasable fastening means 68 is adapted to releasably fastens the channel 64 and shaft 66 to one another at different selected telescoping positions of the shaft 66 within the channel 64 so as to correspondingly permit selective relocation of the front and rear base members 14, 16 toward and away from one another. More particularly, the releasable fastening means 68 includes a plurality of threaded apertures 70 formed therein and spaced from one another along the top of the shaft 66, a hole 72 formed through the top of the channel 64 and alignable with a respective one of the threaded apertures 70 one at a time as the shaft 66 is moved to each of its different selected telescoping positions within the channel 64, and a fastener 74 having a threaded end 74A insertable through the hole 72 of the channel 64 and threadable within the respective one of the threaded apertures 70 of the shaft 66 being aligned with the hole 72 of the channel 64. The fastener 74 preferably is of a type having an upper knob 76 for gripping by the user to turn the fastener 74. However, any other suitable type of fastener may be employed.

Referring again to FIGS. 1 to 4, the top member 20 of the assembly 10 has a substantially rectangular configuration when viewed from above and a substantially L-shaped configuration in transverse cross-section. The top member 20 has a lip 78 extending downwardly from adjacent to its rear side 48 and in a generally perpendicular relation to the top member 20. The lip 78 may abut the side S of the wall W of the bathtub B when the bottom side 44 of the top member 20 is resting on the top T of the wall W of the bathtub B. The lip 78 helps to retain the top member 20 in its desired place on the top T of the wall W of the bathtub B during use of the assembly 10. The the top member 20 in its desired place on the top T of the wall W of the bathtub B during use of the assembly 10. The rest 52 of the top member 20 is surmounted by a pad 80 of relatively soft compressible cushion-like material and has a substantially L-shaped configuration conforming to the shape of the top side 42 and lip 78 of the top member 20 such that the pad 80 substantially covers the lip 78 and the top side 42 which forms the arm/elbow rest 52 of the top member 20.

Referring to FIGS. 1 to 4, 6 and 7, as mentioned above the upright support means 50 supports the top member 20 at the desired height above the front base member 14 and floor F where the top member 20 overlies and rests on the top T of the wall W of the bathtub B. The upright support means 50 includes a lower support member 82, an upper support member 84 and first fastening means 86 for releasably securing the lower and upper support members 82, 84 to one another. The lower support member 82 is U-shaped in cross-section and has opposite upper and lower ends 82A, 82B. The lower support member 82 is vertically slidably coupled at its lower end 82B with the front portion 28 of the front base member 14 and extends upwardly above the rear portion 30 and kneeling rests 22. The upper support member 84 is U-shaped in cross-section and has upper and lower ends 84A, 84B. The upper support member 84 is attached at its upper end 84A to the rear end 48 of the top member 20 and extends downwardly therefrom. The first fastening means 86 is provided on each of the upper end 82A of the lower support member 82 and lower end 84B of the upper support member 84 for releasably securing the upper and lower support members 82, 84 to one another.

More particularly, the lower and upper support members 82, 84 have respective rear walls 82C, 84C and respective pairs of opposite lateral side walls 82D, 84D. The rear walls 82C, 84C are vertically aligned with one another as are the lateral side walls 82D, 84D. The upper end 82A of the lower support member 82 and lower end 84B of the upper support tongue and groove fitting relationship so as to mount the upper support member 84 upon the lower support member 82. The first fastening means 86 includes a pair of forwardly projecting lugs 92 formed on the inside of the rear walls 82C of the lower support member 82 inwardly from and adjacent to the detents 88 on the upper end 82A thereof and open at the exterior thereof, a corresponding pair of forwardly projecting lugs 94 of smaller diameter formed on the inside of the rear wall 84C of the upper support member 84 inwardly from and adjacent to the detents 90 on the lower end 84B thereof and being insertable into the lugs 92, and a plurality of fasteners 96 adapted to be threaded into threaded holes 94A tapped into the lugs 94. Upon being tightened, the fasteners 96 fixedly secure the upper support member 84 to the lower support member 82. Conversely, merely by loosening and removing the fasteners 96, the upper support member 84 may be easily removed from the lower support member 82. Each fastener 96 can be a screw type having wings for gripping by a user's thumb and finger, though may be any other suitable type of fastener.

The upright support means 50 also is adapted for adjustably changing the height of the top member 20 above the front portion 28 of the front base member 14 and thus the floor F. For accomplishing this function, the upright support means 50 also includes a guide channel 98 having a U-shapd configuration and formed on the front portion 28 of the front base member 14, a pair of opposite guide slots 100 formed in and along the lower end 82B of the lower support member 82 and a guide pin 102 extending through opposing holes 104 formed through opposite sides of the guide channel 98 and through the opposite guide slots 100 of the lower support member 82. The presence of the guide pin 102 limits the lower support member 82 to limited vertical movement upwardly from and downwardly toward the guide channel 98 by the length of the guide slots 100 for adjusting the height of the top member 20 so that it toward the guide channel 98 by the length of the guide slots 100 for adjusting the height of the top member 20 so that it will rest on the top T of the wall W of the bathtub B. When the lower support member 82 is raised to the upper limit, it also can be rotated rearwardly toward the seat 18 for placing the top member 20 and upright support means 50 in a storage position overlying the channel 64 and shaft 66 of the front and rear base members 14, 16. These features of the assembly 10, the guide channel 98, slots 100 and pin 102, are generally similar to those disclosed in the aforecited U.S. Pat. No. 5,642,535 which accomplish the same function.

The upright support means 50 is further adapted to increase the height of the top member 20 to above that allowed by the guide channel 98, slots 100 and pin 102 thereof for accommodating bathtubs having walls of more widely variable heights. For accomplishing this function, the upright support means 50 further includes an insert support member 106 and second fastening means 108 for releasably securing the insert support member 106 to and between the lower and upper support members 82, 84. The insert support member 106 has opposite upper and lower ends 106A, 106B and is adapted to be placed between the lower and upper support members 82, 84. The second fastening means 108 is provided on each of the upper and lower ends 106A,106B of the insert support member 106 and releasably connectable to the first fastening means 86 on each of the upper end 82A of the lower support member 82 and lower end 84B of the upper support member 84.

More particularly, the insert support member 106 also has a rear wall 106C, 84C and a pair of opposite lateral side walls 106D which are vertically aligned with the rear walls 82C, 84C and side walls 82D, 84D of the lower and upper support members 82, 84 when the insert support member 106 is disposed therebetween. The upper and lower ends 106A, 106B of the insert support member 106 has upper and lower detents 110, 112 which are complementary to and interfittable with the the lower support member 82 for coupling the corresponding detents 90, 110 and 88, 112 together in a tongue and groove fitting relationship so as to mount the insert support member 106 upon the lower support member 82 and the upper support member 84 upon the insert support member 106. The second fastening means 108 includes upper and lower pairs of forwardly projecting lugs 114, 116 formed on the inside of the rear wall 106C of the insert support member 106 inwardly from and adjacent to the respective upper and lower detents 110, 112 being interfitable with the lower and upper lugs 94, 92 of the upper and lower support members 84, 82 in a similar manner, and a plurality of fasteners 118 adapted to be threaded into threaded holes 120 tapped into the upper lugs 114. Upon being tightened, the fasteners 96, 118 fixedly secure the upper support member 84 to the insert support member 106 and the insert support member 106 to the lower support member 82. Conversely, merely by loosening and removing the fasteners 96, 118 the upper support member 84 may be easily removed from the insert support member 106 and the insert support member 106 may be easily removed from the lower support member 82. Each fastener 118, like each fastener 96, can be a screw type having wings for gripping by a user's thumb and finger, though may be any other suitable type of fastener.

The assembly 10 further includes a pair of securement elements 122, such as conventional rubber suction cups, mounted to the upper support member 84 for contacting the wall W of the bathtub B such that a space is provided therebetween and the upright support means 50 is retained adjacent to the wall W of the bathtub B. Each suction cup 122 is mounted to another pair of lugs 124 formed on the inside of the rear wall 84C of the upper support member 84. While the suction cups 122 are shown mounted to the upper support member 84, they just as readily could be mounted to the lower support member 82.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A seating and kneeling assembly, comprising:

(a) a front base member having opposite top and bottom sides and opposite front and rear portions, said top side defining kneeling rests for receiving knees of a user, said bottom side for resting on a floor, said front portion for placement adjacent to a wall of a bathtub;

(b) a rear base member having opposite upper and lower portions and opposite forward and rearward portions, said lower portion for resting on the floor, said forward portion of said rear base member and said rear portion of said front base member being connected to one another to provide a connection between said rear and front base members, said rearward portion having a substantially wedge-shaped configuration narrowing from a front thereof located adjacent to said forward portion to a rear thereof located remote from said forward portion for accommodating lower legs and feet of the user along opposite sides of said rearward portion of said rear base member;

(c) a seat mounted on said upper portion of said rear base member for receiving buttocks of the user; and (d) means defined on said rear portion of said front base member and said forward portion of said rear base member for releasably adjusting the location of said connection between said front and rear base members so as to selectively relocate said front and rear base members toward and away from one another.

2. The assembly of claim 1 wherein said releasable adjusting means includes:

an elongated channel formed on one of said rear portion of said front base member and said forward portion of said rear base member;

an elongated shaft formed on the other of said rear portion of said front base member and said forward portion of said rear base member and being telescopingly movable within said channel; and means for releasably fastening said shaft and channel to one another at different selected telescoping positions of said shaft within said channel so as to correspondingly selectively relocate said front and rear base members toward and away from one another.

3. The assembly of claim 2 wherein said releasable fastening means includes:

said shaft having a plurality of threaded apertures formed therein and spaced from one another along said shaft;

said channel having one hole defined therethrough and alignable with a respective one of said threaded apertures one at a time as said shaft is moved to each of said different selected telescoping positions within said channel; and a fastener having a threaded end insertable through said hole of said channel and threadable within said respective one of said threaded apertures of said shaft aligned with said hole of said channel.

4. The assembly of claim 1 further comprising:

a top member having opposite top and bottom sides and opposite front and rear ends, said top side defining a rest for receiving forearms of the user, said bottom side for resting on a top of the wall of the bathtub; and means for supporting said top member at said rear end thereof at a height above said front portion of said front base member.

5. The assembly of claim 4 wherein said supporting means includes:

a lower support member having upper and lower ends and being attached at said lower end with said front portion of said front base member and extending upwardly therefrom;

an upper support member having upper and lower ends and being attached at said upper end to said rear end of said top member and extending downwardly therefrom; and first fastening means on each of said upper end of said lower support member and said lower end of said upper support member for releasably securing said upper and lower support members to one another.

6. A seating and kneeling assembly, comprising:

(a) a front base member having opposite top and bottom sides and opposite front and rear portions, said top side defining kneeling rests for receiving knees of a user, said bottom side for resting on a floor, said front portion for placement adjacent to a wall of a bathtub;

(b) a rear base member having opposite upper and lower portions and opposite forward and rearward portions, said lower portion for resting on the floor, said forward portion of said rear base member and said rear portion of said front base member being connected to one another to provide a connection between said rear and front base members, said rearward portion having a substantially wedge-shaped configuration narrowing from a front thereof located adjacent to said forward portion to a rear thereof located remote from said forward portion for accommodating lower legs and feet of the user along opposite sides of said rearward portion of said rear base member;

(c) a seat mounted on said upper portion of said rear base member for receiving buttocks of the user;

(d) a top member having opposite top and bottom sides and opposite front and rear ends, said top side defining a rest for receiving forearms of the user, said bottom side for resting on a top of the wall of the bathtub; and (e) means for supporting said top member at said rear end thereof at a height above said front portion of said front base member and, said supporting means also for adjustably changing the height of said top member above said front portion of said front base member, said supporting means including (i) a lower support member having upper and lower ends and being attached at said lower end with said front portion of said front base member and extending upwardly therefrom, (ii) an upper support member having upper and lower ends and being attached at said upper end to said rear end of said top member and extending downwardly therefrom, (iii) first fastening means on each of said upper end of said lower support member and said lower end of said upper support member for releasably securing said upper and lower support members to one another, (iv) an insert support member having opposite upper and lower ends and being disposed between said lower and upper support members, and (v) second fastening means on each of said upper and lower ends of said insert support member being releasably connectable to said first means on each of said upper end of said lower support member and said lower end of said upper support member for releasably securing said insert support member to and between said lower and upper support members.

7. A seating and kneeling assembly, comprising:

(a) a front base member having opposite top and bottom sides and opposite front and rear portions, said top side defining kneeling rests for receiving knees of a user, said bottom side for resting on a floor, said front portion for placement adjacent to a wall of a bathtub;

(b) a rear base member having opposite upper and lower portions and opposite forward and rearward portions, said lower portion for resting on the floor, said forward portion of said rear base member and said rear portion of said front base member being connected to one another to provide a connection between said rear and front base members, said rearward portion having a substantially wedge-shaped configuration narrowing from a front thereof located adjacent to said forward portion to a rear thereof located remote from said forward portion for accommodating lower legs and feet of the user along opposite sides of said rearward portion of said rear base member;

(c) a seat mounted on said upper portion of said rear base member for receiving buttocks of the user;

(d) a top member having opposite top and bottom sides and opposite front and rear ends, said top side defining a rest for receiving forearms of the user, said bottom side for resting on a top of the wall of the bathtub;

(e) means for supporting said top member at said rear end thereof at a height above said front portion of said front base member, said supporting means including (i) a lower support member having upper and lower ends and being attached at said lower end with said front portion of said front base member and extending upwardly therefrom, (ii) an upper support member having upper and lower ends and being attached at said upper end to said rear end of said top member and extending downwardly therefrom, and (iii) first fastening means on each of said upper end of said lower support member and said lower end of said upper support member for releasably securing said upper and lower support members to one another; and (f) at least one releasable securement element mounted to one of said upper and lower support members for contacting the wall of the bathtub such that said upper and lower support members are retained adjacent to the wall of the bathtub.

8. The assembly of claim 7 wherein said releasable securement element is a suction cup.

9. A seating and kneeling assembly, comprising:

(a) a front base member having opposite top and bottom sides and opposite front and rear portions, said top side defining kneeling rests for receiving knees of a user, said bottom side for resting on a floor, said front side for placement adjacent to a wall of a bathtub;

(b) a rear base member having opposite upper and lower portions and opposite forward and rearward portions, said lower portion for resting on the floor, said forward portion of said rear base member and said rear portion of said front base member being connected to one another to provide a connection between said rear and front base members;

(c) a seat mounted on said upper portion of said rear base member for receiving buttocks of the user; and (d) means defined on said rear portion of said front base member and said forward portion of said rear base member for releasably adjusting the location of said connection between said front and rear base members so as to selectively relocate said front and rear base members toward and away from one another.

10. The assembly of claim 9 wherein said releasable adjusting means includes:

an elongated channel formed on one of said rear portion of said front base member and said forward portion of said rear base member;

an elongated shaft formed on the other of said rear portion of said front base member and said forward portion of said rear base member and being telescopingly movable within said channel; and means for releasably fastening said shaft and channel to one another at different selected telescoping positions of said shaft within said channel so as to correspondingly selectively relocate said front and rear base members toward and away from one another.

11. The assembly of claim 10 wherein said releasable fastening means includes:

said shaft having a plurality of threaded apertures formed therein and spaced from one another along said shaft;

said channel having one hole defined therethrough and alignable with a respective one of said threaded apertures one at a time as said shaft is moved to each of said different selected telescoping positions within said channel; and a fastener having a threaded end insertable through said hole of said channel and threadable within said respective one of said threaded apertures of said shaft aligned with said hole of said channel.

12. The assembly of claim 9 further comprising:

a top member having opposite top and bottom sides and opposite front and rear ends, said top side defining a rest for receiving forearms of the user, said bottom side for resting on a top of the wall of the bathtub; and means for supporting said top member at said rear end thereof at a height above said front portion of said front base member.

13. The assembly of claim 12 wherein said supporting means includes:

a lower support member having upper and lower ends and being attached at said lower end with said front portion of said front base member and extending upwardly therefrom;

an upper support member having upper and lower ends and being attached at said upper end to said rear end of said top member and extending downwardly therefrom; and first fastening means on each of said upper end of said lower support member and said lower end of said upper support member for releasably securing said upper and lower support members to one another.

14. The assembly of claim 13 wherein said supporting means also for adjustably changing the height of said top member above said front portion of said front base member further includes:

an insert support member having opposite upper and lower ends and being disposed between said lower and upper support members; and second fastening means on each of said upper and lower ends of said insert support member being releasably connectable to said first means on each of said upper end of said lower support member and said lower end of said upper support member for releasably securing said insert support member to and between said lower and upper support members.

15. The assembly of claim 13 further comprising:

at least one releasable securement element mounted to one of said upper and lower support members for contacting the wall of the bathtub such that said upper and lower support members are retained adjacent to the wall of the bathtub.

16. The assembly of claim 15 wherein said releasable securement element is a suction cup.

17. A seating and kneeling assembly, comprising:

(a) a base including a front base member having opposite top and bottom sides and opposite front and rear portions, said top side defining kneeling rests for receiving knees of a user, said bottom side for resting on a floor, said front portion for placement adjacent to a wall of a bathtub;

(b) a top member having opposite top and bottom sides and opposite front and rear ends, said top side defining a rest for receiving forearms of the user, said bottom side for resting on a top of the wall of the bathtub; and (c) means for supporting said top member at said rear end thereof at a height above said front portion of said front base member and also for adjustably changing the height of said top member above said front portion of said front base member, said supporting means including (i) a lower support member having upper and lower ends and being attached at said lower end with said front portion of said front base member and extending upwardly therefrom, (ii) an upper support member having upper and lower ends and being attached at said upper end to said rear end of said top member and extending downwardly therefrom, (iii) first fastening means on each of said upper end of said lower support member and said lower end of said upper support member for releasably securing said upper and lower support members to one another, (iv) an insert support member having opposite upper and lower ends and being disposed between said lower and upper support members, and (v) second fastening means on each of said upper and lower ends of said insert support member being releasably connectable to said first means on each of said upper end of said lower support member and said lower end of said upper support member for releasably securing said insert support member to and between said lower and upper support members.

18. The assembly of claim 17 further comprising:

at least one releasable securement element mounted to one of said upper and lower support members for contacting the wall of the bathtub such that said upper and lower support members are retained adjacent to the wall of the bathtub.

19. The assembly of claim 18 wherein said releasable securement element is a suction cup.

* * * * *